US007128495B1

(12) United States Patent
Lill et al.

(10) Patent No.: US 7,128,495 B1
(45) Date of Patent: Oct. 31, 2006

(54) CURB BOX COVER ASSEMBLY

(76) Inventors: Clifford F. Lill, 137 Cornell Ave., Hawthorne, NJ (US) 07506; Kristopher J. Lill, 115 Skyline Dr., Oakland, NJ (US) 07436

( * ) Notice: Subject to any disclaimer, the term of this patent is extended or adjusted under 35 U.S.C. 154(b) by 0 days.

(21) Appl. No.: 11/253,893

(22) Filed: Oct. 19, 2005

(51) Int. Cl.
*E01C 11/22* (2006.01)

(52) U.S. Cl. ..... 404/4; 292/257

(58) Field of Classification Search ..... 404/2, 404/3, 4, 25; 52/19; 137/371; 292/257
See application file for complete search history.

(56) References Cited

U.S. PATENT DOCUMENTS

| | | | | |
|---|---|---|---|---|
| 505,130 | A | 9/1893 | Ryan | |
| 1,654,246 | A | 12/1927 | Egan | |
| 1,941,589 | A * | 1/1934 | Wellons | 292/95 |
| 2,323,886 | A * | 7/1943 | Wirz, Jr. | 292/304 |
| 4,461,597 | A * | 7/1984 | Laurin | 404/25 |
| 4,594,157 | A | 6/1986 | McGowan | |
| 5,071,177 | A * | 12/1991 | Spiess et al. | 292/91 |

FOREIGN PATENT DOCUMENTS

| | | | |
|---|---|---|---|
| JP | 10-140591 | * | 5/1998 |
| JP | 2000-120096 | * | 4/2000 |
| JP | 2004-11247 | * | 1/2004 |

OTHER PUBLICATIONS

Product Description Sheet, Copyright LMT Mercer Group 2004 (3 pages).

* cited by examiner

*Primary Examiner*—Gary S. Hartmann
(74) *Attorney, Agent, or Firm*—W. Patrick Quast

(57) ABSTRACT

A curb box cover assembly includes a covering member having a plurality of first openings for the passage of street water. Also, second opening(s) are provided on the covering member which cooperate with a clamping device to secure the covering member to the catch basin. The clamping device includes one clamp member which includes a first and second contact member connected by a transition member of prescribed thickness. The clamp member rotationally mounts on a pivot member. The pivot member includes a threaded opening to receive a bolt member which is advanced into the threaded opening by an operator's action. The pivot member rotates in response to the operator's action so that the clamp member rotates from a first position to a second position at which the clamp member secures the covering member to the catch basin opening. The contact members can rotate independently of each other to accommodate irregularities in the interior surface of the catch basin.

9 Claims, 8 Drawing Sheets

CURB BOX COVER ASSEMBLY

FIELD OF THE INVENTION

This invention refers generally to curb inlets for surface drainage and more particularly to a cover for a catch basin curb box including improved securing clamping means.

BACKGROUND OF THE INVENTION

Description of the Prior Art

At the present time, catch basin curb boxes are employed along the length of thoroughfares in developed areas. These are set at prescribed distances to facilitate water run-off so as to prevent localized flooding, particularly aggravated by heavy downpours.

At the present time, the opening to the typical cast iron, catch basin curb box comes in a myriad of various contours. These contours vary from town to town and even within a particular town.

There has been thought of and proposed, various techniques, including various cover plate designs, which seek to restrict the passage of assorted debris material into the catch basin. Of major concern are cans and bottles which can cause havoc if they enter the storm sewer systems, resulting in increased costs for removal and possible equipment repairs and, of course, undesirable contamination of our rivers, lakes and streams.

At the same time a catch basin cover should not unnecessarily restrict the water flow rate into the catch basin. Various agencies, for example a State's Department of Transportation (DOT) set standards for acceptable flow rates for a catch basin and covers. These are set to ensure that the basin and/or cover openings do not contribute to a potential flooding problem by unduly restricting water flow while, in the case of the cover, they function to inhibit the passage of certain over-sized items.

So, for example, the DOT for the State of New Jersey requires that each of the openings for new catch basin designs and for retrofit catch basin covers cannot exceed 2.0 inches in the smallest dimension of the opening and is restricted to 7.0 square inches maximum in the overall area.

A particular water flow rate for the basin, with or without a cover, can be assured by allowing for a sufficient number of such holes so that, in fact, there is limited obstruction to the flow of water while still accomplishing the barrier requirements of DOT regulations.

As noted above the contours of the openings of these catch basins vary widely. So the dimensions of these holes have to vary to satisfy the DOT requirements while adapting to accommodate different basin contours. A cost efficient system and methodology to provide a practical solution for such a large number of contours is highly desirable.

A preferable technique for manufacturing catch basins is the sand casting technique. Using this approach, the cast surfaces are often irregular unless a post-casting finishing procedure is employed. Preferably, at most, this finishing procedure is only implemented on the visible surface since it is an unnecessary, cost-wise, to do so on both sides. Thus the interior surface typically is highly irregular as is known in the art. In addition, the interior surface is oftentimes angled. These characteristics render the clamping of a cover plate to the catch basin problematic.

In U.S. Pat. No. 1,654,246, a grating or guard for a catch basin is described which includes a plurality of openings "which will exclude entry to the basin from the gutter of material of a size greater than can pass through the openings in the grating or guard . . . [for example] sticks, tin cans, and rags". This design describes, a means for securing the grating to the opening which includes a "recess 41" in each side of the "curb 25". Each recess receives the free outer end of a spring 42. The latter snaps into its respective recess "in the act of pushing the grating or guard 36 into place." The "springs . . . [are] relatively strong so as to prevent the cover from being readily pulled out." Also, although "[t]he opening 37 in the curb is shown as made to correspond with the shape of the grating or guard illustrated in the drawings", "[i]t . . . [is] to be understood . . . that the grating or guard may take other forms."

Recently, the LMT Mercer Group of Lawrenceville, N.J., has brought to the market a catch basin cover made of thermoplastic and formed by an injection molding process. The cover is secured to the catch basin using a bracket, bolt and washer. The bracket includes a serrated portion and is positioned in a slot so as to allow for the grabbing of the adjacent catch basin area by the serrated section.

Also U.S. Pat. No. 505,130 discloses a removable locking grate section, U, which snugly fits within the open front of the curb box. A five-sided locking screw passes through a counter sunk opening in the grate and engages a threaded lug which is formed as part of the curb box. The specially configured locking screw can only be removed by authorized personnel.

U.S. Pat. No. 4,594,157 describes an inlet screen which is secured in the opening of the curb box using an F-shaped clamp.

While these designs afford a certain ability to protect against larger debris from entering the catch basin they have certain drawbacks. Therefore, a primary object of this invention is a cover assembly for a catch basin which will address the myriad numbers of opening contours associated with catch basins with a resulting, respective product which is practical and realistically priced.

A further object is to provide a product which can be confidently secured, even against the irregular, angled interior surface of most catch basin castings and which cannot be removed easily.

It is still a further object of this invention to provide a curb box cover assembly which installs in minutes over standard and custom-sized catch basin castings.

Yet another object is to provide a methodology which permits rapid production of a large and different array of cover plates for standard and custom sized catch basin curb boxes.

It is still another object to provide a steel product which will withstand the deleterious effects of time, weather and environs.

SUMMARY OF THE INVENTION

Towards the accomplishment of these and other objects and advantages, many of which will become more apparent after a reading of the following specification and consideration of the accompanying drawings, there is disclosed a catch basin opening cover assembly.

The cover assembly includes a covering member which typically has a plurality of first openings for the passage of street water. Also second opening(s), positioned on the covering member at predetermined location(s), in close proximity to the contour of the catch basin opening cooperate with means for clamping the covering member to the catch basin. The means for clamping cooperating with each second opening include one clamp member, said at least one clamp member characterized as including at least a first and second contact member. Each contact member has a respective contact surface for contacting a respective portion of an interior surface of the catch basin. Each contact member further includes at least a first, covering member contact surface portion and a second, covering member contact surface portion.

In the preferred embodiment described, the clamp member rotationally mounts on a pivot member about a first axis. The pivot member includes a threaded opening having a second axis perpendicular to the first axis. A respective bolt member is positioned through a particular second opening to engage the threaded opening of an associated pivot member. The bolt member advances along the second axis by an operator's action. The pivot member is adapted to rotate in response to the operator's action in a manner whereby the clamp member rotates about the pivot member from a first position to a second position as the bolt member is advanced along the second axis. At this second position, said at least one of the contact member's respective contact surfaces contacts its respective portion of the interior surface of the catch basin. Also at this second position, the second cover contact surface of that particular contact member contacts the cover member, such that the covering member is secured in place over the catch basin opening.

The clamp member is adapted such that the contact members can rotate independently of each other, so that when the first of the contact members contacts its respective portion of the interior surface of the catch basin, the remaining contact member(s) continues to rotate in response to the operator's action until it contacts its respective portion of the interior surface of the catch basin.

In the preferred embodiment, the clamp member, typically made of steel, includes a transition member which is connected between the contact members. The ability to rotate independently of each other after the first contact member contacts its respective portion of the interior surface of the catch basin, is due, at least in part, to the fact that the material connected between each said contact member is of a predetermined thickness.

DESCRIPTION OF THE PREFERRED EMBODIMENT

Figure 1:
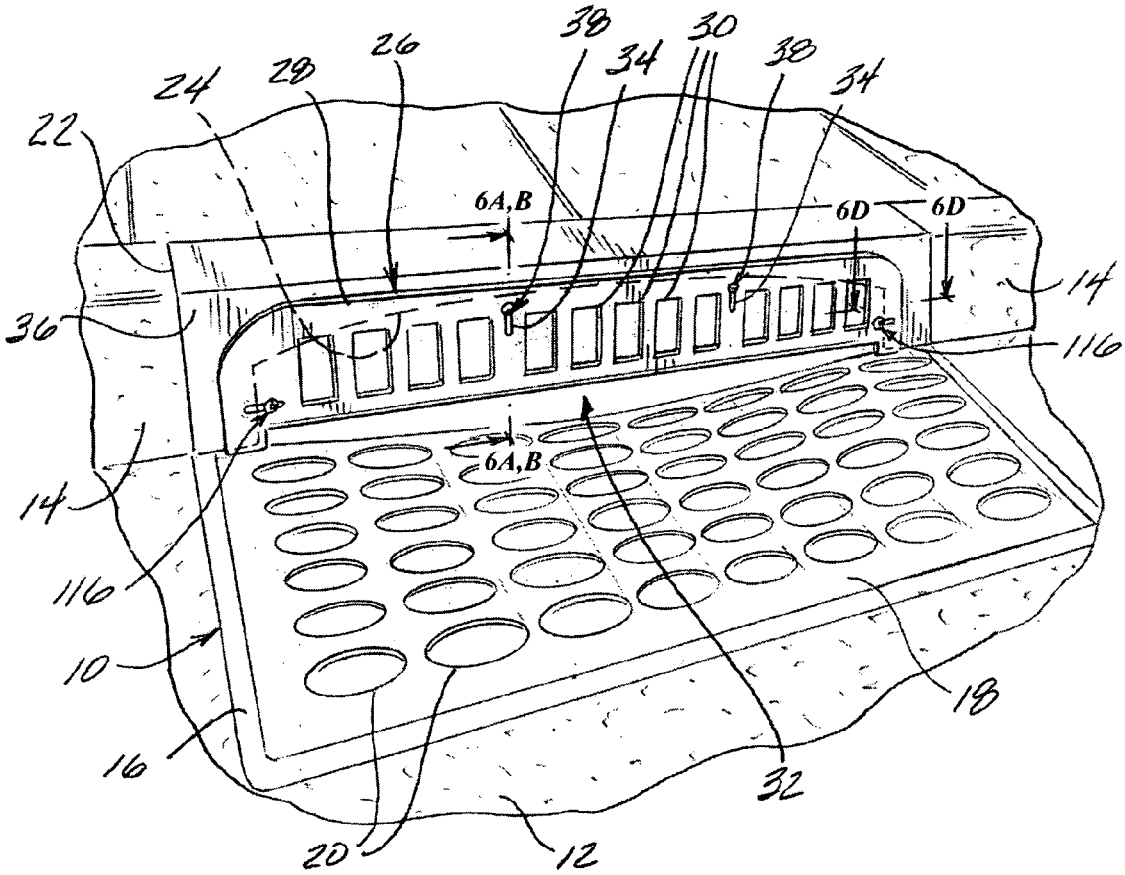
FIG. 1 is a perspective view of a catch basin box with the cover assembly of the present invention shown in place.

Refer now to FIG. 1. There is depicted a catch basin box 10 positioned in place in street 12 and curb 14 in a known manner. Catch basin frame 16 is appropriately dmensioned so as to accept a street grate 18. The latter includes a plurality of openings 20 which facilitate a discharge of the water run-off into the storm drain accessed through the catch basin box.

A curb piece portion 22 includes a catch basin opening having a prescribed, contour 24 which is shown dotted in FIG. 1.

The area of the street grate openings 20 and the catch basin opening are sized so as to provide a sufficient area to handle the anticipated water run-off at the location of the catch basin box.

The contoured opening, for example 24, has, over the years, experienced various shapes and sizes and it is one of the primary purposes of this invention to address the myriad of openings that presently exist.

Notwithstanding, these contoured openings did not preclude the passage of cans, bottles, and other, larger sized objects from entering the catch basin and thus the storm drain system.

With increased sensitivity to the need to keep our environment free from such debris, particularly cans, bottles and the like, several products such as the present invention have been developed to provide a retrofit cover assembly for existing, in-place catch basins as a solution to the problem.

The cover assembly 26 of the present invention includes a covering member 28. This covering member includes at least one and, typically, a plurality of first openings 30. These openings 30 are sized to maximize the flow of the water run-off and to prevent the larger objects from entering the catch basin. The dimensions of these openings are set by a controlling, regulatory agency. For example, the DOT for the State of New Jersey has provided regulations which control any one dimension of these openings 30 so as not to exceed 2 inches with the total area any one opening to be no more than 7 inches maximum.

A second, first opening 32 may be formed in the covering member 28 as a result of the strengthening technique employed as described below. As a consequence, opening 32 assists in water run-off. Again, as depicted in FIG. 1, the vertical dimension of this opening 32 would be less than the maximum dimension required by the controlling agency.

The covering member 28 also includes at least one, and typically, again, a plurality of second openings 34. Each of these second openings, if more than one, is formed in the covering member 28 in a predetermined location in near proximity to the expected location of the contoured opening 24 for the particular catch basin opening to be covered. The location of the second opening(s) 34 again will vary depending on the various contours that exist and which will be experienced on a given job.

The form of the first opening(s) 30 also will vary depending on the contour of the catch basin opening that is to be covered. (See also FIGS. 7, 8 and 9).

In order to secure the covering member 28 to the front face 36 of the curb piece portion 22, means for clamping, 38, are employed. These cooperate with the second openings, such as 34, and the adjacent portions of the covering member, and the interior side (not shown in FIG. 1) of the face portion 36 of the curb piece portion of the catch basin box.

Figure 2:
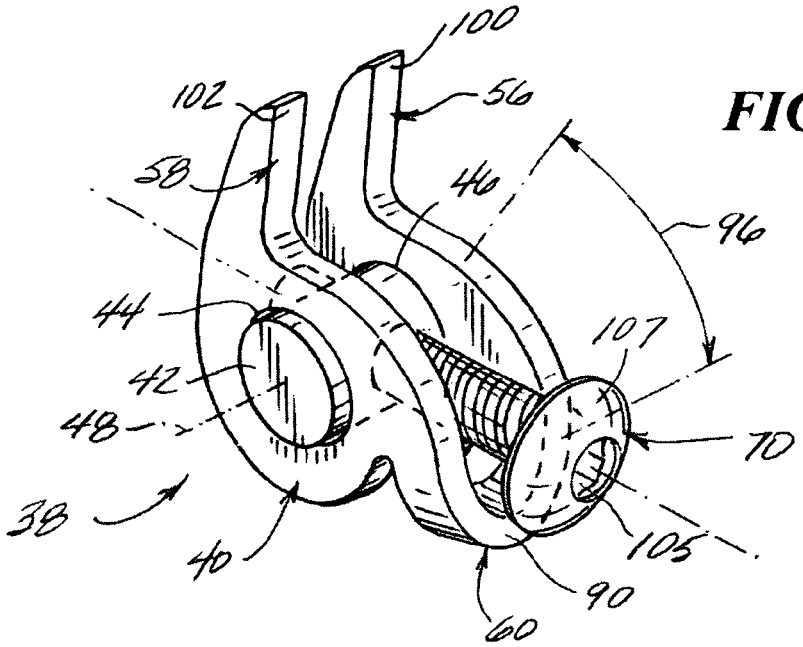
FIG. 2 is a perspective view of the means for clamping the covering member, showing the assembled relationship of the components.

The number of means for clamping that are to be employed will be a quantity sufficient to adequately secure the covering member 28 to the front face 38 of the catch basin. In addition to FIG. 1, refer now to FIGS. 2 and 3. In FIG. 2, the means for clamping 38 are seen to include in the preferred embodiment, a formed clamp member 40. The clamp member 40 is mounted on a pivot member 42. As best appreciated in FIG. 3, pivot member 42 is positioned in openings 44 and 46 which are co-axially aligned along a first axis 48 when the clamp member is formed. The pivot member includes an annular groove 50 and a threaded opening 52. The axis of the threaded opening is perpendicular to the first axis 48.

Figure 3:
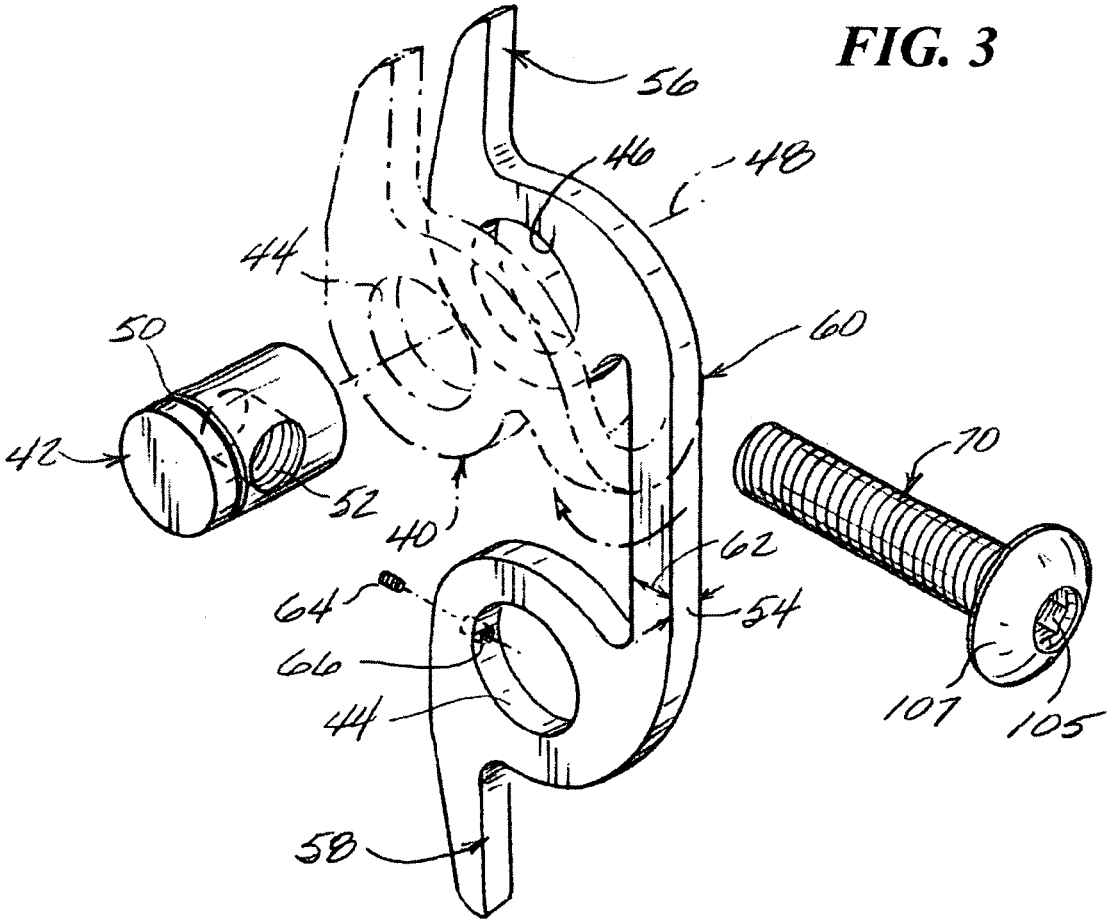
FIG. 3 is an exploded view of the means for clamping of FIG. 2 and also indicating the procedure for forming the clamp member portion of the means for clamping.

Referring to FIG. 3, the clamp member 40 is formed from a sheet of material, typically steel, which is a ¼ inch in the thickness dimension, 54. The metal sheet stock is the same as used to form the covering member described below. The pre-formed shape of the preferred embodiment is as shown in solid lines in FIG. 3. The cut piece includes a first and second catch basin contact member 56 and 58. These are intergrally connected by a transition member 60 which is approximately ⅜ inches in the width dimension, 62.

After cutting the basic clamp member, it is then formed into its final shape by bending the piece about the transition member 60 so that openings 46 and 44 of the first and second contact members, 56 and 58, again, are co-axially aligned along the first axis 48. To complete the assembly, the pivot member 42 is then inserted into the aligned openings 44 and 46. The pivot member 42 is secured in these openings through the use of a set screw 64. This screw engages a threaded-through opening 66 in one of the contact members, for example 58, and is advanced in that opening until its tip contacts the annular groove 50 of pivot member 42. The cooperative action between the set screw and the annular groove initially prevents the pivot member from turning freely in openings 44 and 46; however, the formed clamp member 40 is able to rotate about the pivot member during the assembly operation as described below. The set screw 64 typically is made of a synthetic material such as nylon. Alternately, this screw may be made of metal with a tip fashioned of material of less hardness than that used to make the pivot member 42, again, for example, nylon.

The angular displacement (65, FIG. 6A) of the contact members 56, 58, when first assembled to the covering member 28, is sufficiently positioned away from the interior surface 98 of the catch basin so as to minimize any clearance problems at point of assembly of the covering member to the catch basin. This is better appreciated from FIGS. 6A and 6B. The set screw 64 cooperates with the annular groove to retain the clamp member 40 in a fixed position to the pivot member 42, again to facilitate its assembly to the covering member 28 and further to assist in the assembly process needed to secure the covering member to the catch basin face.

Figure 4:
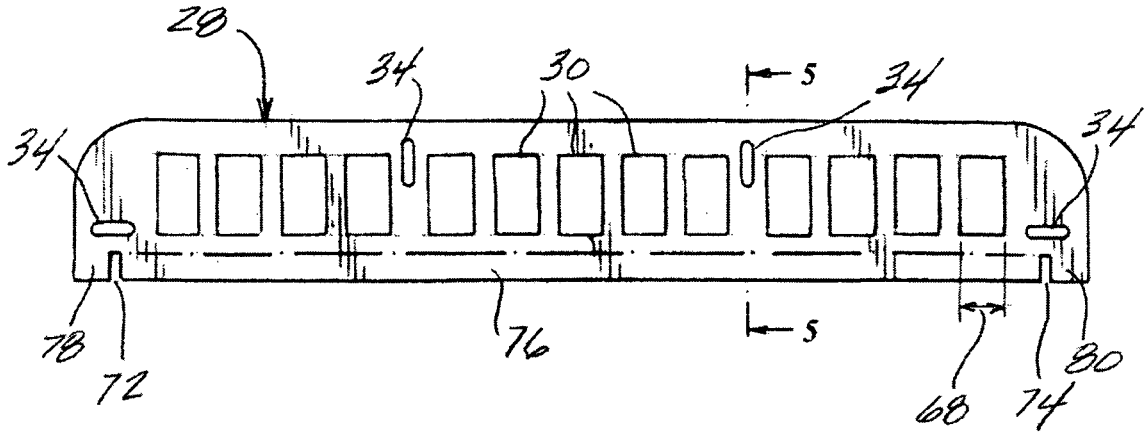
FIG. 4 is a front elevation view of the covering member of the present invention as first cut from stock material.
Figure 5:
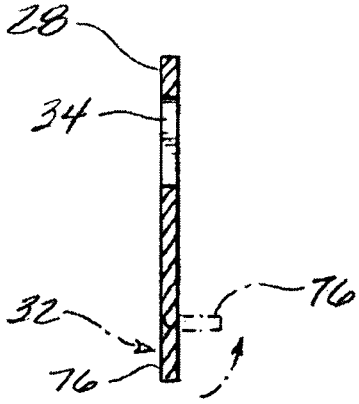
FIG. 5 is a sectional view taken along lines 5—5 of FIG. 4 and showing the finishing operation to form the covering member of the present invention.

FIGS. 4 and 5 depict the forming process of one version of the covering member 28. This, too, is cut from sheet metal material which is nominally ¼ inch thick. It includes at least one first opening 30, and typically a plurality of such openings which, in the embodiment depicted in FIG. 4, are a plurality of parallel openings of rectangular shape disposed in a vertical arrangement, as viewed in FIG. 4. As noted above, the dimensions of the opening(s) 30 are usually dictated by the governmental agency charged with such matters, for example the Department of Transportation in a particular state. For example, the State of New Jersey DOT requires such openings to have one dimension, for example 68, that can't exceed 2 inches maximum. This dimension will then preclude the passage of cans and bottles and other large material, thus insuring the primary purpose of these retrofit coverings. Still further, the openings must have a maximum area and an adequate number which will insure little or no impact on the required water flow rate at a particular catch basin.

The covering member includes at least one, second opening 34. Typically there are a plurality of such openings which are available to secure the means for clamping previously described. The bolt member 70 (see FIGS. 2 and 3) passes through these openings 34 which are of a diameter slightly larger than the shank of the bolt 70. These can be slotted so as to compensate for tolerance build-ups in the catch basin box, the elements of the cover assembly and surveying (the field procedure used to establish the contour of a particular basin opening) errors.

Figure 8:
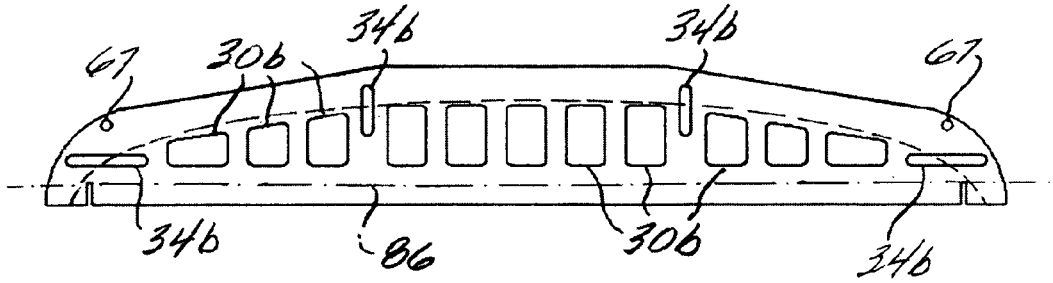
Figure 9:
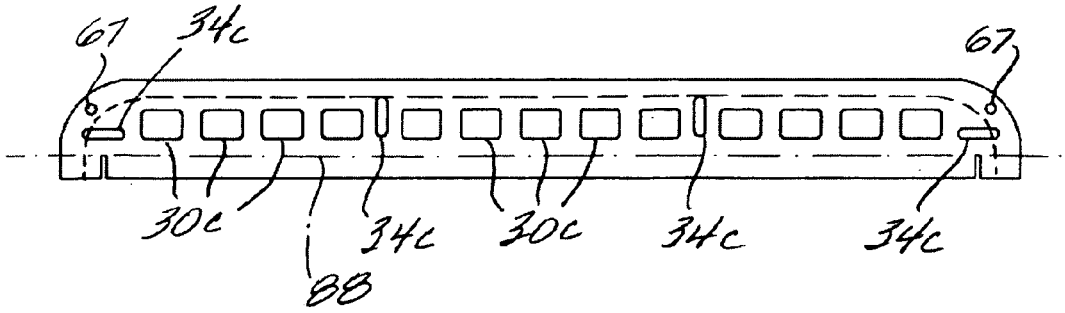

In forming the finished product, the covering member of the embodiment of FIG. 4, as well as FIGS. 8 and 9, includes the cutting of slots 72 and 74. These are cut to a vertical height, as viewed in FIG. 4, to permit a bend portion 76 which is formed at typically right angles to the vertical orientation of the member 28 to strengthen the covering member 28, especially if the latter is relatively thin. The second, first opening 32 is typically formed by this process and, again, further alleviates any obstructive effect on the water flow at a particular basin. This bend portion does not necessarily need to be included, for example see FIG. 9, especially for shorter length and/or thicker, covering members.

Figure 7:
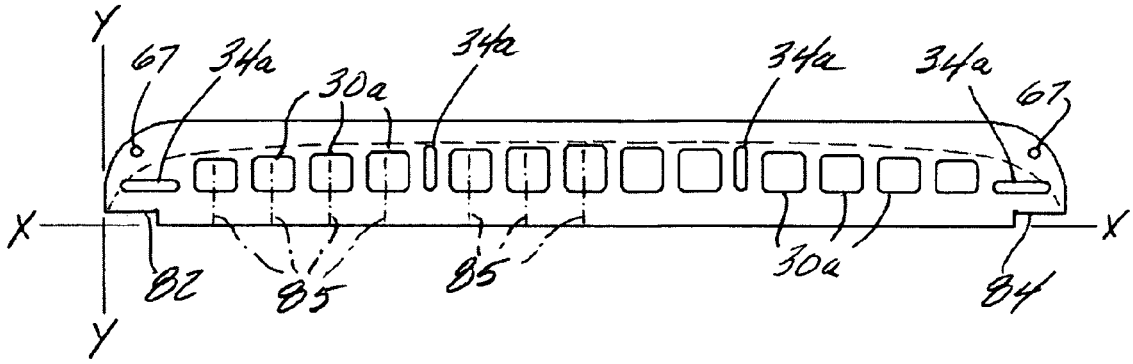
FIGS. 7, 8 and 9, are front elevation views of different covering members, designed to provide the benefits of the invention for differently contoured catch basin openings.

In cutting the slots and forming the bend portion 76, tabs 78 and 80 will remain as part of the covering member, in the vertical plane. These act as stanchions, supporting the covering member on the street grate and facilitating the assembly of the covering member to the catch basin 18. In the embodiment of FIG. 7, where the bend portion is not formed, the covering member in that embodiment would rest on the grate along its entire length, or on shoulders, 82 and 84 (see FIG. 7), if the tabs, such as 78 and 82, are cut off from the particular embodiment of the covering member piece. Again these variations in design accommodate the multitude of existing catch basins that can be confronted.

Again FIGS. 7, 8 and 9 show the configuration of the covering members for different applications. The first openings, which functionally correspond to opening 30, are seen to include various sizes and shapes for any given covering member embodiment. The contour for each of the catch basin openings is shown for each embodiment in dashed lines. Again, the basic one dimension limitation, for example, 2.0 inches, as might be dictated by a particular DOT, remains, with the area of each opening reflective of the particular contour dimension experienced and recorded by a surveyor at the location for each basin, keeping in mind, in the design phase, the maximum, acceptable area for any one opening.

The process for determining the contour dimensions of any given embodiment, in its simplest form is established by surveyors who prepare templates for each contour of each basin that they experience in the field. The template typically need only be made of one-half of the catch basin opening (the other representing the mirror image), and returned to the manufacturing facility. There measurements are taken from the the template and entered into a suitably programmed computer which then provides accurately dimensioned machining drawings from which the covering member can be manufactured.

It is anticipated that this process can be improved upon by taking a series of vertical measurements to the contour of the catch basin opening, at various horizontal distances along the horizontal length of the catch basin. Superimposed on the covering member embodiment in FIG. 7 for example, is an XY grid. The field agent would simply measure and record the vertical height to the contoured opening for each of a series of x-positions identified as 85. The heights for these positions would be returned again to the manufacturing facility where they could be inserted into a suitable computer program which would then direct the machining of a particular embodiment resulting in a customized covering member suitable for that particular catch basin opening. The computer program would be adapted to shape the first openings 30, 30*a*, 30*b*, 30*c*, etc. so as to take into account the vertical dimension of the contour opening at a particular x dimension, while controlling the opening area requirements as dictated by the involved agency. Second openings 34, 34*a*, 34*b*, 34*c*, etc. are also suitably located so as to facilitate the cooperative engagement of the clamping means with the catch basin surface. Simple, circular thru holes 67 can be provided for bolting the cover member to the catch basin for unusual basin opening configurations. Referring to FIGS. 8 and 9, bend lines 86 and 88 define the point of bending where the bend portion, similar to 76 in FIGS. 4 and 5, are formed.

Figure 6A:
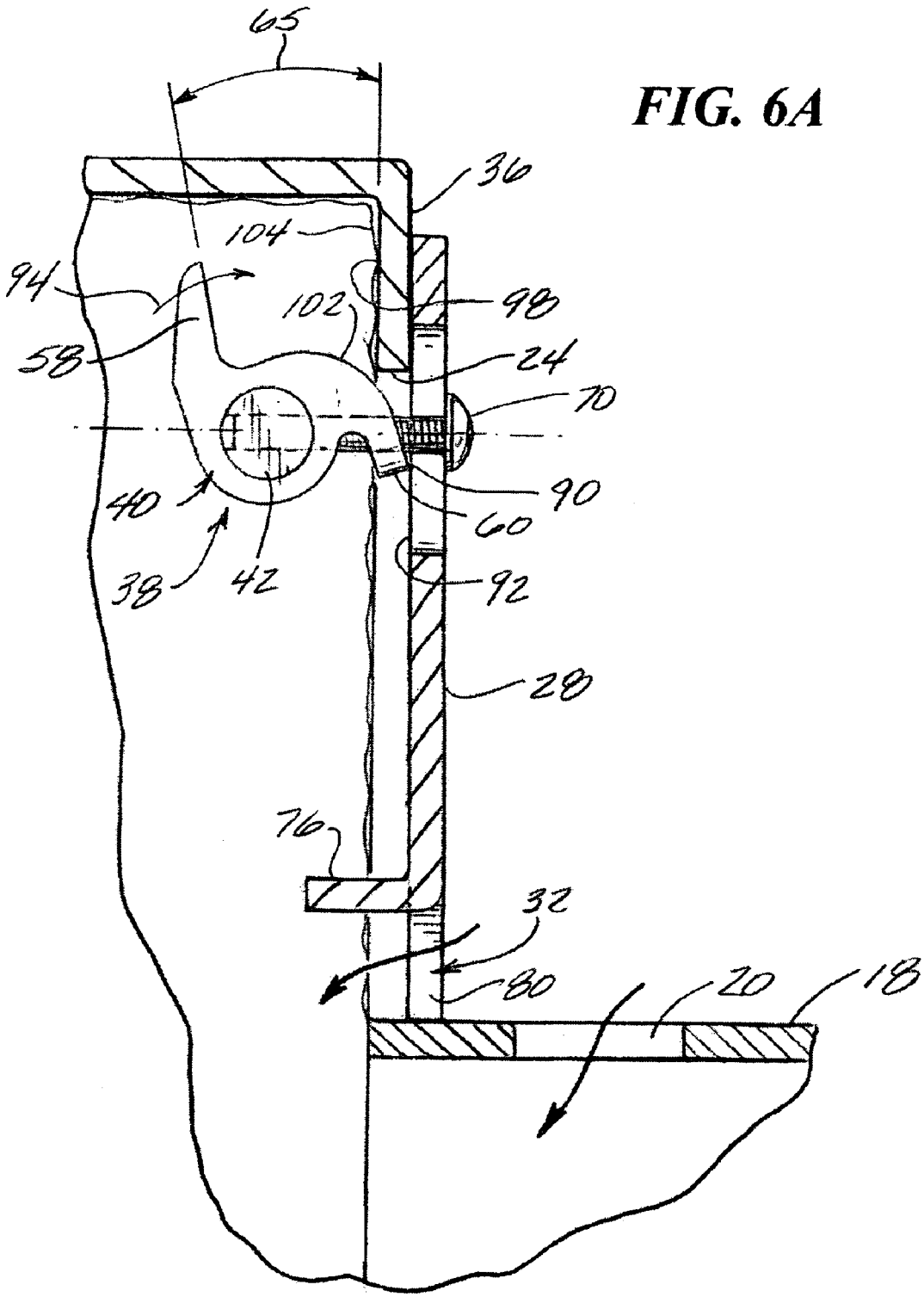
FIGS. 6A and 6B are each a side elevation view taken along lines 6—6 in FIG. 1 showing the covering member in place in front of the catch basin and demonstrating the use of the means for clamping of the present invention.
Figure 6B:
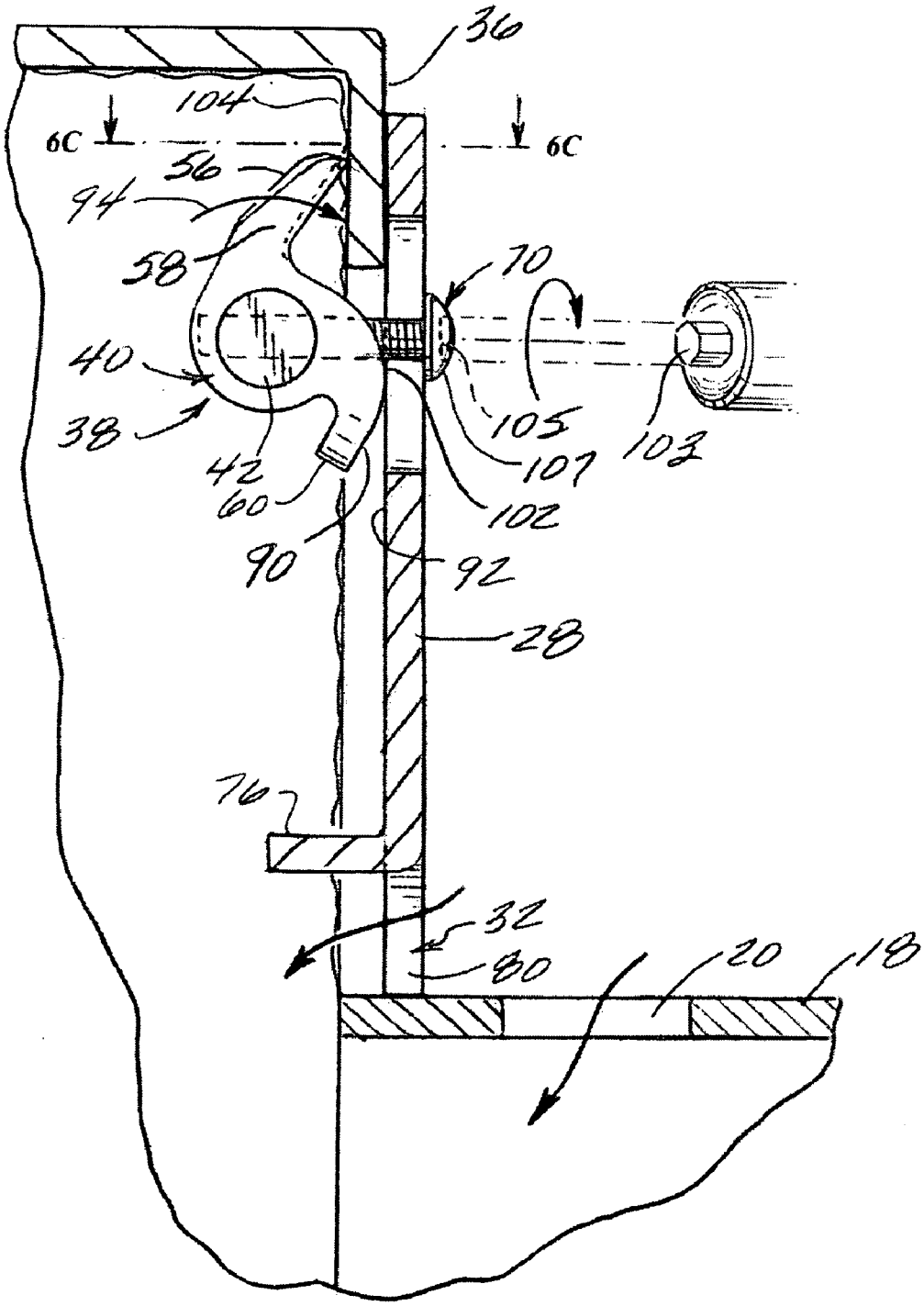
Figure 6C:
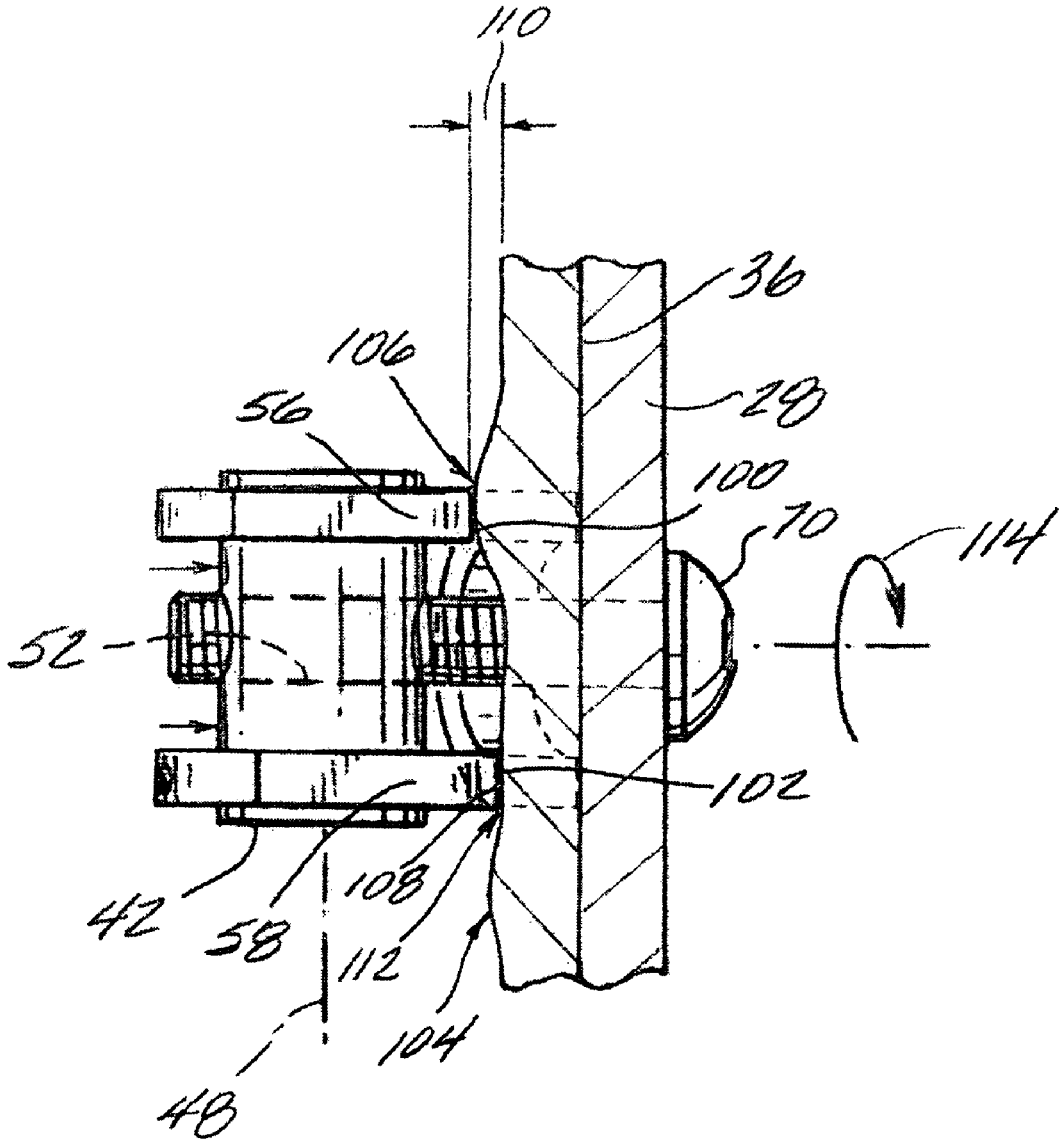
FIG. 6C is a sectional top plan view of a portion of the catch basin showing the adaptation of a portion of the means for clamping to the irregularities of the interior surface of the front face portion of the catch basin.

Refer now to FIGS. 6A, 6B and 6C. FIG. 6A depicts the means for clamping 38, assembled to the covering member 28. Initially the clamp member 40, secured on the pivot member 42 is positioned behind the covering member 28. This is done prior to assembly of the covering member 28 to the catch basin face portion 36. The bolt 70 is inserted through the corresponding second opening 34 in the covering member and then engages the threaded opening 52 of the pivot member 42. As noted above, the clamp member 40 is held in a fixed position in relationship to the pivot member 42 by sufficiently tightening down the set screw 64 on the annular groove 50 of the pivot member. The relationship between the contact members, 56(not visible) and 58, and the casting face 36 is typically as it appears in FIG. 6A at the point of initial assembly.

When first secured to the covering member, as the bolt 70 is drawn up in the threaded hole by an operator, a first covering member contact surface portion 90, typically located on the transition member 60 of the clamp member 40, engages the interior surface 92 of the covering member 28. As the bolt is further threaded into the opening 52, the clamp member 40, leveraged by the contact between the first covering member contact surface portion and the covering member, rotates in the direction 94. The surface of the clamp member 40 in contact with the interior surface of the covering member moves through a range 96 (see FIG. 2) until one or both of the contact members 56, 58 reach the interior surface 98 of the catch basin. Assuming a smooth interior surface 98, the respective, second covering member, contact surface portions 100, 102 of the first and second contact members 56 and 58 are drawn against the interior surface 98, generally, simultaneously. The covering member 28 is now secure to the face portion 36 of the catch basin (FIG. 6B).

After the bolt is tightened as necessary, it is important that vandals, or other unauthorized individuals not be able to easily remove the bolts, 70. To this end, a slug member, 103, can be provided, which is so configured so as to be force fitted into the opening 105 in the bolt head. This can be accomplished through use of a suitable tool which retains the slug as the tool is positioned in proximity to the bolt. The tool is struck and the slug is driven into the opening 105 with enough force to securely wedge it into the opening. The slug is typically fashioned from a steel grade which is somewhat softer than the bolt material. In the insertion process, the slug material flows sufficiently to fill the opening and is generally flush to the surface 107 of the bolt head.

FIG. 6C illustrates the respective engagements of contact members 56 and 58 with a typical, irregular interior surface 104 of the catch basin, curb piece face 36. As noted above, this irregularity results from the sand casting process typically employed in fabricating catch basin curb boxes. As illustrated, the respective first and second contact members, 56 and 58 will engage the irregular surface at respective portions 106 and 108 at their respective contact surfaces 100 and 102. It is not unreasonable to expect that the separation distance 110 between the two contact portions 106 and 108 of the irregular surface 104 can be as much as ¼ inch.

For the irregular surface condition depicted in FIG. 6C, contact member 56 is seen to strike the irregular surface 104 before the second of the two, 58, contacts it. However, in accordance with the principles of the invention, the continued rotation of bolt 70 in the direction indicted, 114, causes the clamp member, 40, secured to the pivot member 42 to rotate further in the contact range 96 until the second contact surface portion 102 meets the irregular surface at point 112. This ability to continue rotation even though one contact member has met the irregular surface, is facilitated by the thickness of transition member 60. The thicknesses 54 and 62 are determined, at least in part, so as to allow the two contact members 56 and 58 to in effect rotate independently when one is restrained from further rotation as illustrated in FIG. 6C.

Figure 6D:
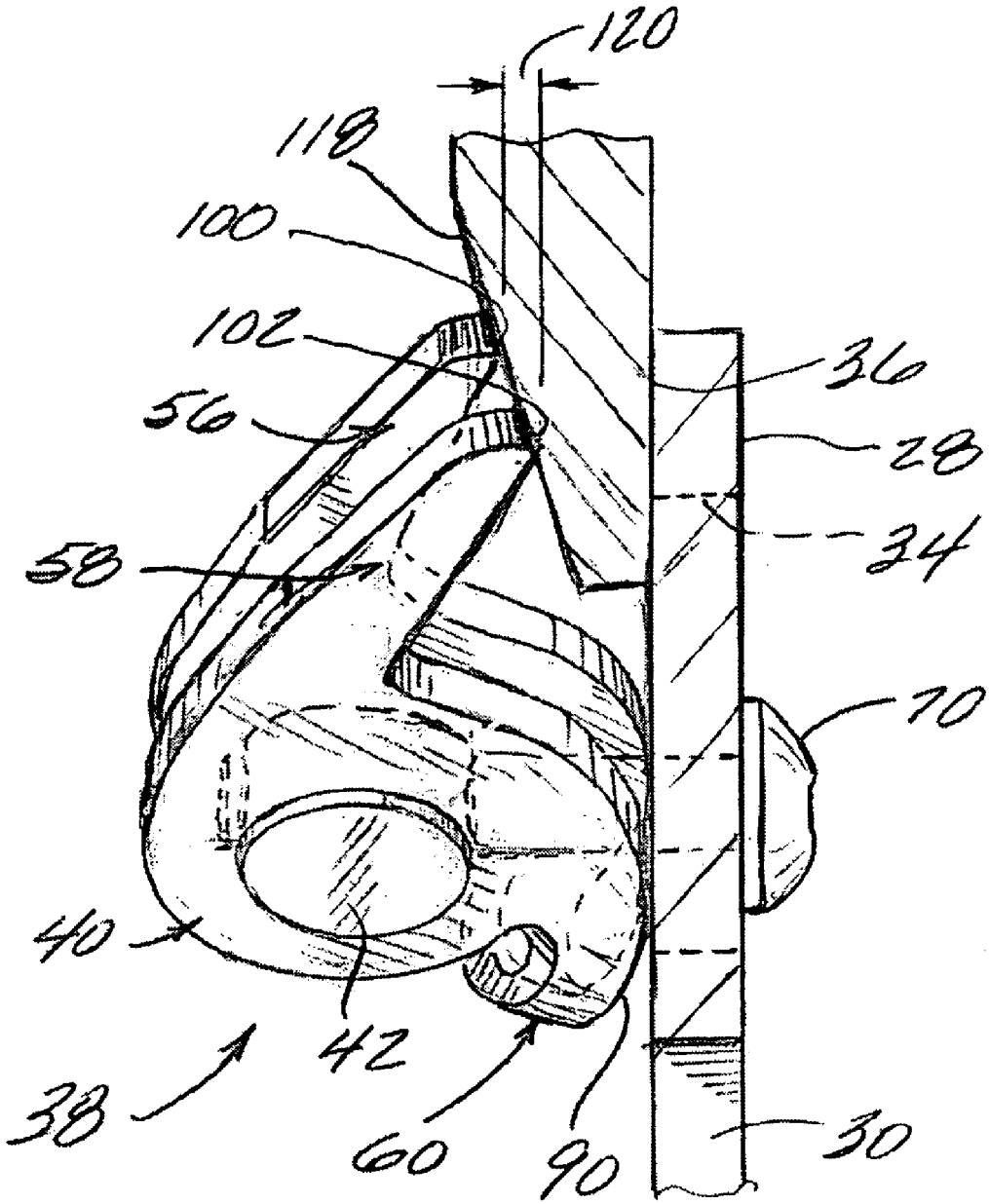
FIG. 6D is a sectional elevation view of a portion of the catch basin showing the adaptation of a portion of the means for clamping to the angularity of the interior surface of the front face portion of the catch basin.

In FIG. 6D, taken along view line 6D in FIG. 1, a unique problem is addressed which involves the horizontally disposed clamping means 116 (FIG. 1), when employed. In this regard, one other manufacturing aspect of the catch basin curb box, as illustrated in FIG. 6D, the chamfered interior surface 118, must be addressed. Because of the bevel, the difference 120 between the contact points for each of the two contact members, can be as much, again, as a ¼ inch. This is on top of the discrepancies attributable to the irregularity of the interior surface noted above, due to the casting process. Notwithstanding, the independent movement principle of the present invention allows the clamping means of the invention to easily accommodate these discrepancies ensuring a firm and secure retention of the covering member in place.

The covering member 28 as well as the stock material used to form the clamp member 40, is fabricated from a metal plate, preferably ¼ inch thick, of Cor-Ten® A steel, a product of United States Steel Corporation. This type steel is familiarly used for dividers, girders, and bridges and achieves a dark brown appearance after exposure to the environment.

While a preferred embodiment has been described, the scope of this invention can not be seen as limited thereto. For example, while the formed clamp member is seen as a single piece formed from sheet metal and bent into the configuration depicted in FIGS. 2 and 3, each of the contact members, 56 and 58, can be formed individually, without a transition member, 70. These individual members could each be secured to respective annual grooves formed in pivot member 42, so that the independent movement of the two is assured. Other adaptations are envisioned, all within the scope of the invention as defined in the following claims.

What is claimed is:

1. A cover assembly for a catch basin opening comprising:

(a) a covering member including at least one first opening for the passage of water therethrough, and at least one second opening said at least one second opening positioned on said covering member at a predetermined location;

the catch basin opening having a prescribed contour, said predetermined location in close proximity to the contour when said covering member is positioned in its intended place in front of the catch basin opening; and (b) means for clamping the covering member to a portion of the catch basin, said means for clamping cooperatively engaging a respective one of said at least one second opening whereby the covering member covers the catch basin opening, said means for clamping including;

(i) at least one clamp member, said at least one clamp member characterized as including at least a first contact member, said at least said first contact member having a respective catch basin contact surface for contacting a respective portion of an interior surface of the catch basin, said at least said first contact member further characterized as including at least a first covering member contact surface position and a second covering member contact surface position;

(ii) a rotating member, said at least one clamp member cooperatively engaging said rotating member; and, (iii) means for rotating said rotating member engaged by said clamp member, said rotating member adapted to rotate in response to an operator's action in a manner whereby said at least said first contact member proceeds from said first covering member contact surface position to said second covering member contact surface position;

where, at said second covering member contact surface position, said at least said first catch basin contact surface contacts said respective portion of the interior surface of the catch basin, such that said covering member is secured in place over the catch basin opening.

2. The cover assembly claimed in claim 1 wherein said at least one clamp member includes at least a second contact member, said at least said second contact member having a respective catch basin contact surface for contacting a respective portion of the interior of the catch basin, said at least said second contact member further characterized as including a respective first covering member contact surface position and a respective second covering member contact position;

where, at its said respective second covering member contact surface position, said at least said second catch basin contact surface of said second contact member contacts its said respective portion of the interior surface of the catch basin.

3. The cover assembly claimed in claim 2 wherein said cover assembly is further adapted so that said at least said first and second contact members can rotate independently of each other such that when the first of said at least said first and second contact members contacts its respective portion of the interior surface of the catch basin, the second of said at least said first and second contact members continues to rotate in response to the operator's action until said second contact member contacts its respective portion of the interior surface of the catch basin.

4. The cover assembly claimed in claim 2 wherein the clamp member includes a transition member, said transition member connected between said at least said first and second contact members.

5. The cover assembly claimed in claim 4, wherein said at least said first and second contact members can rotate independently of each other after the first of said at least said first and second contact members contacts its respective portion of the interior surface of the catch basin, due, at least in part, to the thickness of said transition member.

6. A cover assembly for a catch basin opening comprising:

(a) a covering member including at least one first opening for the passage of water therethrough and at least one second opening, said at least one second opening positioned on said covering member at a predetermined location, the catch basin opening having a prescribed contour, said predetermined location in close proximity to the contour when said covering member is positioned in its intended place in front of the catch basin opening; and (b) means for clamping the covering member to a portion of the catch basin whereby the covering member covers the catch basin opening, said means for clamping including;

(i) at least one clamp member, said at least one clamp member characterized as including at least a first and second contact member, each said contact member having a respective contact surface for contacting a respective portion of an interior surface of the catch basin, each said contact member further characterized as including at least a first covering member contact surface portion and a second covering member contact surface portion;

(ii) a pivot member; and, (iii) a bolt member;

said clamp member rotationally mounted on said pivot member about a first axis, said pivot member including a threaded opening having a second axis perpendicular to the first axis, said bolt member positioned through said at least one second opening and advancing along said second axis when threaded into said threaded opening by an operator's action, said pivot member adapted to rotate in response to the operator's action;

such that said clamp member is adapted to rotate about said pivot member from a first position to a second position as said bolt member is advanced along said second axis, such that at said second position, said at least one of the contact member's respective contact surfaces contacts its respective portion of the interior surface of the catch basin.

7. The cover claimed in claim 6 wherein said clamp member is adapted such that said at least said first and second contact members can rotate independently of each other such that when the first of said at least said first and second contact members contacts its respective portion of the interior surface of the catch basin, the second of said at least said first and second contact members may continue to rotate in response to the operator's action until said second contact member contacts its respective portion of the interior surface of the catch basin.

8. The cover assembly claimed in claim 7 wherein the clamp member includes a transition member, said transition member connected between said at least said first and second contact members.

9. The cover claimed in claim 8 wherein the ability of said at least said first and second contact members to rotate independently of each other after the first contact member contacts its respective portion of the interior surface of the catch basin is due, at least in part, to the fact that the transition member connected between each said contact member is of a predetermined thickness.

* * * * *